United States Patent [19]

Link et al.

[11] Patent Number: 4,626,163

[45] Date of Patent: Dec. 2, 1986

[54] MOUNTING STEP FOR CRAWLER LOADER

[75] Inventors: Joseph E. Link, Farley; James F. Oeth, Dubuque, both of Iowa

[73] Assignee: Deere & Company, Moline, Ill.

[21] Appl. No.: 780,229

[22] Filed: Sep. 24, 1985

Related U.S. Application Data

[63] Continuation of Ser. No. 553,612, Nov. 21, 1983, abandoned.

[51] Int. Cl.[4] ..... E02F 3/04

[52] U.S. Cl. ..... 414/685; 37/DIG. 3; 37/DIG. 12; 280/166; 414/722

[58] Field of Search ..... 414/685, 722; 280/163, 280/165, 166, 167 R; 180/69.2, 6.44, 6.48; 37/117.5, 118 R, 118 A, DIG. 3, DIG. 12

[56] References Cited

U.S. PATENT DOCUMENTS

| | | | |
|---|---|---|---|
| 2,634,989 | 4/1953 | Skreberg | 280/163 X |
| 2,663,099 | 12/1953 | Klages | 37/117.5 X |
| 2,711,341 | 6/1955 | Mills et al. | 180/69.2 X |
| 3,450,218 | 6/1969 | Looker | 180/6.44 |
| 3,986,503 | 10/1976 | LeGuillon | 280/166 X |
| 4,301,607 | 11/1981 | Inui | 37/118 R |
| 4,462,485 | 7/1984 | Terry et al. | 280/166 X |

*Primary Examiner*—Frank E. Werner
*Assistant Examiner*—Donald W. Underwood

[57] ABSTRACT

A mounting step is fixed to a rear side location of a loader bucket. The step is spaced forwardly of one drive track when the bucket is in a lowered position resting on the ground and permits an operator to step to or from the top of the drive track with the aid of a grab handle on an engine enclosure.

2 Claims, 1 Drawing Figure

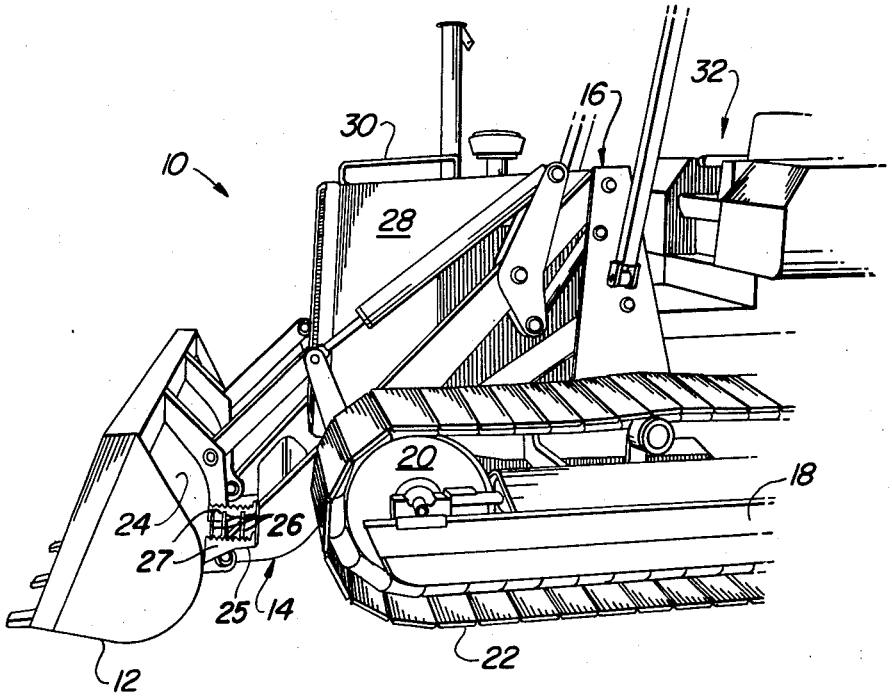
10
30
28
16
32
20
18
24
26
27
25
14
12
22

MOUNTING STEP FOR CRAWLER LOADER

This application is a continuation of application Ser. No. 553,612, filed Nov. 21, 1983, now abandoned.

BACKGROUND OF THE INVENTION

The present invention relates to tractor mounting steps and more specifically relates to mounting steps for crawler loaders.

The endless tracks of crawler tractors are located at opposite sides of the vehicle and therefore are in the path of an operator mounting or dismounting the vehicle. Heretofore, it has been a practice to provide a step located on the track frame within the confines of the endless track. However, this location is very poor since mud carried by the track often falls upon the step and makes it difficult to find and dangerous to step upon.

SUMMARY OF THE INVENTION

According to the present invention, there is provided a mounting step particularly adapted for use with a crawler loader.

An object of the invention is to provide a mounting step which is located so as not to be subject to being covered by mud or the like while at the same time being located so that an operator can easily step to and from the top of the track.

A more specific object is to secure a mounting step to the back side of the loader bucket so that when the bucket is resting on the ground the step is correctly positioned for mounting the vehicle.

These and other objects, features and advantages of the present invention will become apparent to those skilled in the art from the description which follows and from the drawing.

BRIEF DESCRIPTION OF THE DRAWING

The sole FIGURE shows a crawler loader as viewed from a leftward location.

DESCRIPTION OF THE PREFERRED EMBODIMENT

Referring now to the drawing, there is shown a crawler loader 10 including a bucket 12 pivotally coupled to the forward end of an arm assembly 14 which has its rearward end pivotally coupled to a frame post assembly 16. Outboard of the arm assembly are right- and left-hand track frames 18 (only one shown) having idler wheels 20 mounted on the forward ends thereof in fore-and-aft alignment with respective drive sprockets (not shown) adjacent the rear ends of the track frames. An endless drive track 22 (only one shown) is trained about each aligned wheel and sprocket set.

The bucket 12 is shown resting on the ground with a left end portion 24 thereof located in fore-and-aft alignment with the drive track 22. A step 25 is fixed, as by welding, to the rear side of the bucket end portion 24 and projects rearwardly toward the track 22. Specifically, the step 25 includes a plurality of parallel cross members 26, extending between a pair of side plates 27, thus forming an open step structure. Located on top of an engine enclosure 28 so as to be in substantial sideways alignment with the forward end portion of the track 22 is a grab handle 30.

Thus, to mount the crawler loader 10, an operator steps onto the step 25 and then to the top of the track 22 swith the aid of the grab handle 30. The top of the track 22 is used as a walkway along which the operator proceeds to an operator's station 32 located centrally on the loader behind the frame post assembly 16. Material which may adhere to the step 25 from time to time is caused to be knocked off during normal operation of the loader in filling and dumping the bucket 12.

What is claimed is:

1. In a crawler loader having a bucket coupled to the forward end of a support arm structure and being selectively positionable in a lowered position, a fore-and-aft extending drive track located entirely outwardly of the support arm structure and having a forward end spaced rearwardly from an end portion of the bucket and an engine enclosure and operator's station located inwardly of the drive track, the improvement comprising: an open step structure fixed to a rear surface of said end portion of the bucket in alignment with and projecting toward a forward end of said drive track when the bucket is in said lowered position so as to be useable by an operator mounting or dismounting the crawler loader.

2. The crawler loader defined in claim 1 and further including a grab handle fixed to the top of the engine enclosure at a location adjacent a front end portion of the drive track.

* * * * *